US005406731A

United States Patent [19]

Stevens

[11] Patent Number: 5,406,731

[45] Date of Patent: Apr. 18, 1995

[54] HANDGUN OF IMPROVED ERGONOMIC CONSTRUCTION

[75] Inventor: Philip H. Stevens, Skaneateles, N.Y.

[73] Assignee: Smith & Wesson Corp., Springfield, Mass.

[21] Appl. No.: 199,803

[22] Filed: Feb. 22, 1994

[51] Int. Cl.[6] ..... F41C 23/00

[52] U.S. Cl. ..... 42/71.02

[58] Field of Search ..... 42/71.02, 7, 16, 17, 42/18

[56] References Cited

U.S. PATENT DOCUMENTS

| | | | |
|---|---|---|---|
| D. 230,974 | 3/1974 | Howlett | 42/71.02 |
| 2,997,924 | 8/1961 | Rosebush | 42/7 |
| 3,128,571 | 4/1964 | Herrett | 42/71.02 |
| 3,815,270 | 6/1974 | Pachmayr | 42/71.02 |
| 5,231,237 | 7/1993 | Cupp | 42/71.02 |

FOREIGN PATENT DOCUMENTS

| | | | |
|---|---|---|---|
| 2386011 | 10/1978 | France | 42/71.02 |
| 1805399 | 8/1970 | Germany | 42/71.02 |

*Primary Examiner*—David Brown

*Attorney, Agent, or Firm*—Chapin, Neal & Dempsey

[57] ABSTRACT

An ergonomic semi-automatic handgun includes a pivotable trigger with a concave face portion disposed in front of the grip portion whereby when the trigger is pivoted, the center of the concave portion will travel in a generally straight line towards the base of the saddle parallel to the axis of the barrel and at an optimum distance from the barrel. A unitary polymeric frame including a semi-cylindrical front strap is disposed at predetermined angle relative to the barrel. A ridge and channel are formed on each side of the frame and are adapted to guide and retain the thumb and forefinger of a shooter in the appropriate position to hold, aim and fire the gun.

10 Claims, 2 Drawing Sheets

HANDGUN OF IMPROVED ERGONOMIC CONSTRUCTION

FIELD OF THE INVENTION

This invention relates to firearms and more particularly to an improved ergonomic configuration of semi-automatic pistols or handguns.

BACKGROUND OF THE INVENTION

Semi-automatic pistols, although being widely adopted by law enforcement agencies in recent years, are not, particularly in the larger calibers and at high rates of fire, the easiest type of handgun to control and accurately fire. A number of considerations are involved in the design of such handguns including the configuration and dimensioning of the handgrip and its relationship to the trigger and other controls so as to improve the fit between the gun and shooting hand of the majority of users. It is the intent of this invention to provide a secure and comfortable handgrip and with its dimensional relationship to the trigger, one that will facilitate the aiming and firing of the gun for the first and each succeeding round.

One of the principal concerns in such design is the adaptation of the relatively small area of the handgrip inherent to all handguns for the shooting hands of all the persons of all sizes and shapes who may be called upon to use the handguns which embody this invention. In the adaptation of mechanical devices for manual control, while it is relatively simple to custom-fit the device for particular individuals, it is an entirely different matter when the device is to be adapted to interfit with a broad cross-section of the population. It is especially difficult to design a handgun for modern-day law enforcement organizations, which in recent years have become a great deal more inclusive in the selection of its officers in relation to the make up of the overall population. Indeed, such organizations are likely to include a wide variety of racial and ethnic groups as well as male and female officers all of whom make for an officer universe of greater diversity of sizes and shapes than ever before. In the design of handguns of the type embodying this invention, the guns are designed to be held primarily by one hand, although in some instances, the non-shooting hand may be used to support or to be superimposed about the shooting hand to help steady the gun.

Another factor contributing to the difficulties associated with holding, aiming and accurately firing a handgun, is the relatively strong recoil force. Recoil being the reactive force that is equal and opposite to the force that is imparted to the bullet expelled from the barrel of the gun is in line with the longitudinal axis of the barrel. Since the shooter's hand is disposed on the grip below the recoil axis, a moment arm exists which tends to rotate the gun upwardly as well as rearward. After each round is fired, the gun must be retargeted mostly in a generally downward direction for each subsequent round and when firing a semi-automatic pistol, especially in a rapid fire mode, the gun can be quite difficult to control and may result in fatigue of the shooter's hand, wrist, arm and other upper body muscles. In such situations, the shooter's performance levels have been found to drop off rather sharply and it has been difficult for law enforcement agencies which include greater numbers of women to achieve consistently high scores on the firing range.

A recently published article in the December 1992 edition of *THE POLICE CHIEF* entitled: *THE IMPORTANCE OF ERGONOMICS IN SEMI-AUTOMATIC WEAPONS SELECTION* discusses this very problem. That article, based upon the scores of 216 students who participated in firearms training, concluded with a finding that of the women tested there was a failure rate of forty percent (40%) as compared to four percent (4%) for the men who were also tested. The greater failure rate among the women was primarily attributed to the women's generally smaller hand size and lesser upper body strength.

In attempting to improve the shooter's comfort and the accuracy of handguns over the years, many shooting aids and other devices have been suggested. Such devices range from simple grip adapters to more elaborate custom contoured grips and modern cushioned grips, as variously disclosed, for example, in U.S. Pat. Nos. 926,529; 3,027,673; 3,815,270; 4,043,066; 4,132,024; 4,148,149; 4,242,824; 4,286,401; 4,359,833 and 4,586,282. While in one way or another, some of these cushioning devices have been help fill in reducing discomfort to the shooter's hand caused by recoil of the gun, they also tend to enlarge the grip and/or to adversely affect the "feel" or control of the gun and thus make for less accuracy, especially for shooters with smaller hands. In short, such grips have not proved entirely satisfactory from the standpoint of improving the ergonomics incident to the interfit of the handgun and the shooter's hand sizes particularly when used in handgrips of general or universal application.

It is a principal object of this invention to provide a semi-automatic handgun having an improved handgrip incorporating human factors principals that is adapted for more effective and safer performance by shooters of broader anthropological cross-section than heretofore.

A further object of this invention is to provide a semi-automatic handgun of the above type characterized by an improved inherent pointability.

A still further object of this invention is to provide a semi-automatic handgun having a grip configuration for ease of use and comfort.

A still further object of this invention is to provide a semi-automatic handgun of the above type having the capability of improved accuracy by greater numbers of shooters.

In accordance with this invention, a semi-automatic handgun is defined by a unitary polymeric frame which supports a reciprocably movable slide thereon. A portion of the frame comprises a handgrip that includes a metacarpal receiving portion defined by a front strap, a back strap and side cheeks and a concave saddle is formed along the upper portion of the back strap, contiguous with the uppermost rear portion of the frame. A concave channel in the form of a recess is provided on each side of the frame and extends from a point adjacent the saddle toward the trigger. Each channel is adapted to receive and support, for both right and left-hand shooters, the thumb on one side of the frame and at the same time, the forefinger on the opposite side thereof. Each of the channels is further defined by a convex ridge at the lower edge thereof that extends from adjacent the lower end of the saddle to a point adjacent the front strap and the trigger. The metacarpal portion of the handgrip is generally below the ridges and is defined by convexly curved front and back straps and side cheeks formed with palm swells that fare smoothly with the curved surfaces of the front and back straps.

The above and other objects and advantages of this invention will be more readily apparent from a reading of the following description of an exemplary embodiment thereof taken in conjunction with the following drawing.

DETAILED DESCRIPTION OF THE PREFERRED EMBODIMENT

Figures 1, 2, 3:
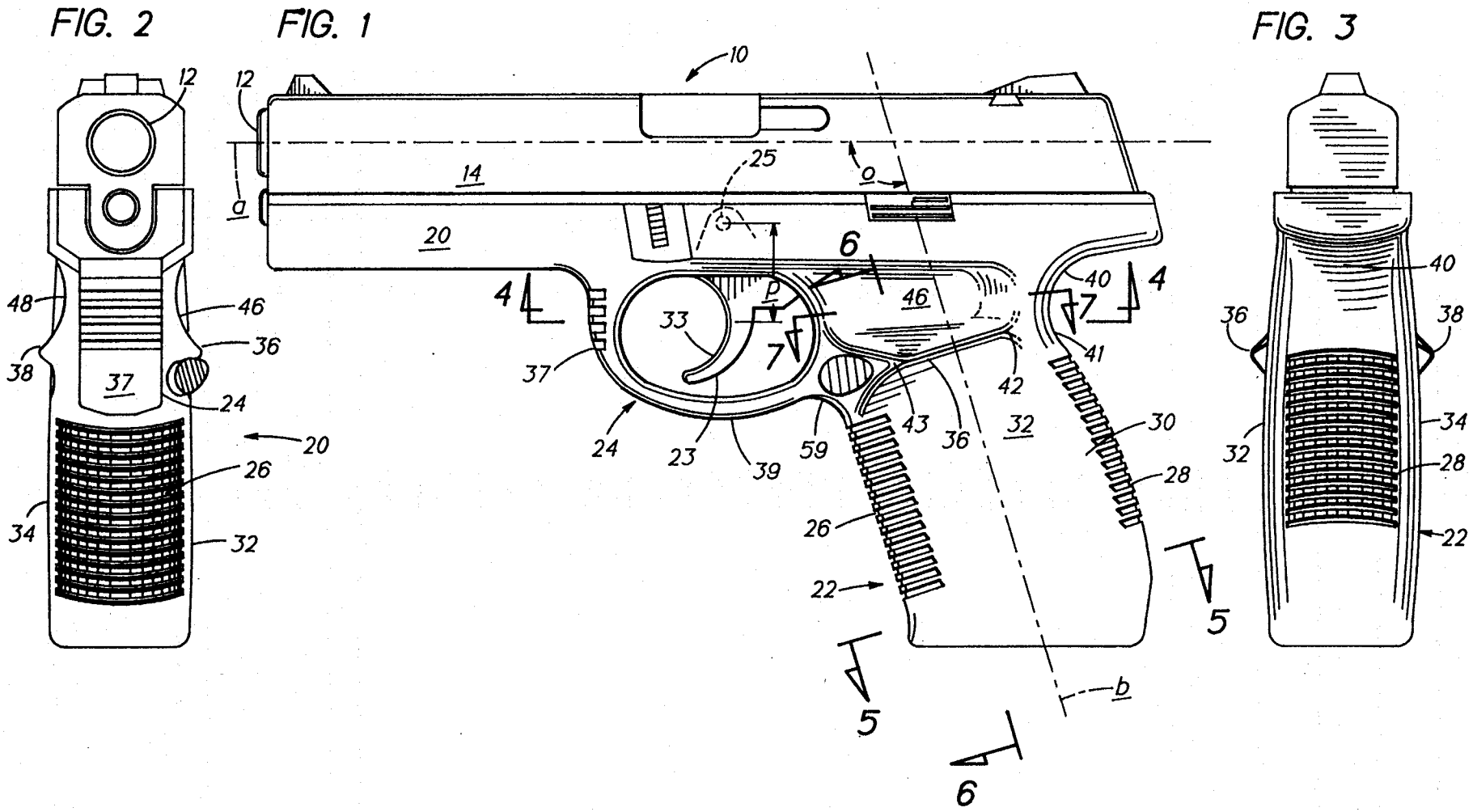
FIG. 1 is a side elevational view of a semi-automatic handgun of the type embodying the present invention.
FIG. 2 is a front elevational view of the handgun.
FIG. 3 is a rear elevational view of the handgun.

Referring to FIG. 1, a semi-automatic handgun 10 of this invention comprises a barrel 12 disposed at a front end of a slide 14. The barrel 12 and the slide 14 have a common longitudinal axis a and the slide is fitted onto a unitary polymer frame 20 for reciprocable movement along the upper edges thereof. A portion of the frame comprises a handgrip 22 that extends downwardly and rearwardly at an oblique angle o of approximately 106 to 110 degrees relative to the axis a of the slide and forward portion of the frame. A trigger 23 is pivotable about a transverse pin 25 rearwardly to actuate the firing mechanism (not shown) and fire the gun. The pivot pin 25 is disposed at approximately the midpoint of the length of the frame 20 and the finger engaging portion of the trigger 23 is disposed within a trigger guard 24 that includes a forward limb 37 and lower limb 39 and which guard 24 is disposed at the junction of the slide and the upper portion of the forward surface of the handgrip 22 which surface is known in the art as the "front strap", as at 26. The orientation shown in FIGS. 1 and 3, in which the axis a of the slide 14 is generally horizontal and the grip 22 is in vertical alignment therewith, constitutes the "normal firming position" of the handgun 10 in which orientation the present invention is described herein.

The handgrip 22 of the frame includes therein a downwardly opening chamber 27 (FIG. 5) of generally rectangular cross-section for receiving therein a magazine (not shown). This invention concerns primarily the external configuration and dimensioning of the handgrip and its relation to the trigger and barrel of the gun. The handgrip 22 comprises a portion adapted to receive the metacarpal, or palm, portion of the shooter's hand, the middle, ring and small fingers thereof, herein referred to as the metacarpal portion 30 of the grip. The grip 22 is generally of rectangular cross-section and is defined by the front strap 26 and back strap 28, side surfaces or cheeks 32 and 34 and a saddle 40. The outer surfaces of the front and back straps are oppositely and convexly curved about radii of approximately 0.490–0.510 inch. The side cheeks 32 and 34 are also equally curved convexly about radii of 2 to 4 inches which blend smoothly or fair with the curvatures of the front and back straps. The front strap 26 is disposed at an oblique angle o with respect to the axis a of the barrel, preferably on the order of 108 degrees, as will hereinafter be discussed.

On each side of the handgrip is a ridge 36 and 38, respectively, that extends along a transverse line generally normal to the longitudinal axis b on each side of the handgrip. Each of the ridges 36 and 38 extends from a point 42 forwardly of a transition point 41 at the lower end of concave saddle 40 and the upper end of the convexly curved back strap 28. At the other, or forward end thereof, each of the ridges terminates at a point 43 rearwardly of the junction of the lower limb 39 of the trigger guard 24 and the front strap 26. A concave recess or channel 46 and 48 is disposed on each side of and along the upper portion of the handgrip and in generally parallel relationship with the ridges 36 and 38 which define the lower edges of the channels on each side of the grip 22. The channels are of a length, width and depth to accommodate either the thumb pad or the pad of the third joint pad of the index finger of the shooter's hand. The channel 46 on the left side of the gun serves as a thumb rest for right-handed shooters while the channel 48 on the right side, serves at the same time as a positioning guide for the index finger of the right-handed shooter. These two channels are important in that they provide a grip reminder and retaining grooves for the pincer fingers of the shooter's hand whereby the pincer fingers, when disposed in the channels, are generally parallel to each other and lie in a plane generally perpendicular to a vertical plane containing the barrel axis for aiming and thus controlling the pointability of the handgun embodying this invention. The saddle 40 at the tipper end portion of the back strap is adapted to be engaged by the fleshy web portion of the shooting hand between the thumb and forefinger thereof and in combination with the channels and ridges, the saddle serves to provide a superior grip for an anthropologically broader universe of shooters. Moreover, the trigger includes a concave finger-engaging face portion that is disposed a straight line distance r (FIG. 4) from the back strap of approximately 2.60 inches for easy reach by the majority of potential adult users of this type of handgun.

The front strap 26 has a generally cylindrical convex outer surface defined by a radius of approximately 0.490 to 0.510 inch and which is preferably uniform over the entire length of the handgrip from the lower limb of the trigger guard 24 to the lower edge thereof. The back strap 28, unlike the front strap, is vertically curved as well as having a horizontally radiused contour of approximately 0.490 to 0.510 inch and a variable curvature defined by a radius of 10–15 inches extending over the length of the metacarpal portion of the grip. Preferably, the smaller radius will be at the lower end of the back strap 28 for better fit with the palm of the shooter's hand. At the upper end of the backstrap the vertical curvature terminates at the transition point 41 where it fares smoothly together with the saddle 40 having a concave vertical configuration defined by a radius of approximately 0.5 inch. It also has a horizontally radiused cross-section of the same order of magnitude as the back strap 28. Both the front strap and back strap are textured to increase the coefficient of friction between the operator's hand and the grip. The forward limb 37 of the trigger guard 24 is similarly textured on the front surface thereof to increase the friction to the forefinger of the non-shooting hand in those instances in which the non-shooting hand is superimposed about the shooting hand to help steady the gun.

The configurations and dimensions of the front and back straps 26 and 28 have been found to contribute to the enhanced pointability and grip comfort particularly for smaller handed shooters. The improved pointability is in part attributable to the above-described features and, in particular, the angle o between the axis a of the barrel and the axis b of the handgrip in combination with the ridges 36 and 38 and channels 46 and 48 and the orientation of the channels and ridges on each side of the gun.

Other important features of the gun 10 that contribute to consistent aiming or pointing include the relationship of the back strap and the saddle that fare together smoothly at the transition point 41. As previously mentioned herein, with the web portion of the shooting hand fitted snugly in saddle 40, the distance for the index finger to engage comfortably the trigger (the trigger reach r) is on the order of 2.60 inches or approximately 2.5–2.7 inches. Approximately eighty percent (80%) of females tested would have had no trouble in reaching the concave face 33 of the trigger 23 with the first joint of the index finger of the shooting hand when the web of that hand is centered along the middle of the saddle 40. In addition, at a point approximately 0.250–0.500 inch forward of the midpoint of the saddle 40, channels 46 and 48 extend forwardly on each side of the gun generally toward the center of the trigger 23. In effect, these channels serve to guide the forefinger and thumb into the preferred position for aiming the gun. The surfaces within the channels are smooth but with a matte finish for easy movement thereover but without being slick or slippery in texture. Each of the channels is of concave configuration formed by a radius in vertical plane that is perpendicular to the axis a of the barrel of approximately 0.300 to 0.325 inches and a radius in a generally horizontal plane perpendicular to the axis b of the handgrip 22 which is approximately 0.465 to 0.625 inches.

Figure 6:
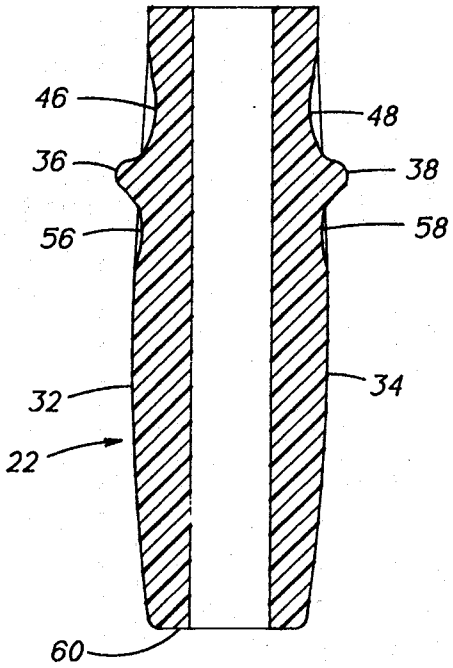
FIG. 6 is a cross sectional view taken along line 6—6 of FIG. 1.

The ridges 36 and 38 each serve as a thumb rest on opposite sides of the frame and together with the channels 46 and 48, provide this all-important-area of the grip to enhance the control and aiming or pointability of the gun. This configuration not only provides greater areas of surface contact between the all-important pincer fingers, but do so in a highly directional manner. Thus, on one side of the gun, the thumb is securely retained in the channel and the thumb's lower surface is disposed against the upper surface of the ridge while on the other side, the forefinger, especially the fleshy pad of its lower joint, is securely retained in the channel and against the ridge. Moreover, it will be noted that the thumb and forefinger are generally disposed in parallel relationship in a plane perpendicular to the handgrip axis. There is also a slight depression 56 and 58 immediately below and generally parallel to each of the ridges 36 and 38 respectively, as best shown in FIG. 6, to further to assist in the gripping of the gun embodying this invention. One of the ridges 36 and 38 is disposed on one side to support the shooter's thumb while on the opposite side of the gun, the other ridge is disposed to be nestled between the first and second fingers of the shooter's hand, the latter finger finding residence in the recess 58 for a right-handed shooter.

As best shown in FIGS. 1–3, each of the ridges 36 and 38 has a generally triangular profile and which originate at a point 42 approximately 0.25–0.50 inch forwardly of the transition point 41 of the back strap 28 and the saddle 40. The ridges rise smoothly from the side surface of the handgrip 22 and gradually increase in height to their terminal ends 43 (FIG. 1) located approximately 0.25–0.50 inch from the junction of the front strap and the trigger guard. The apex of each of the ridge forms a spine-like ridge line between these points and is disposed generally perpendicular to the axis b of the handgrip or at an angle of approximately 15 to 21 degrees with respect to the axis a of the barrel. That angle and the angle o complementary thereto were based upon a number of actual tests and it was found that the angles which produce the best results are approximately 18 and 108 degrees respectively. Indeed, it was at those angles that the most consistent results in the aiming or pointing of the handgun 20 were achieved. In the tests a number of shooters were given a handgun and asked to aim the gun at a target. The shooters were then blindfolded and asked to again aim the gun at the target and while still blindfolded, they were then asked to repeat the procedure while holding their trigger finger and thumb clear of the gun. This test was conducted with twenty (20) shooters who found that their aim was least affected in the latter situation when using a gun embodying this invention as compared to another test using a competitive pistol.

The combination of channels 46 and 48 and ridges or thumb rests 36 and 38 enable a substantial portion of the weight of the gun to be borne by the upper surfaces of the thumb and forefinger or the pincer fingers. Indeed, as one skilled in the art of kinesthetics will recognize, those two fingers are the dominant for use in manipulation of tools and other such manual operations. Furthermore, the symmetrical disposition of these features permit ambidextrous operation of the gun in which pointability, feel and control have been enhanced. Tests conducted with both right and left-handed users have shown that they are able to grasp and aim the handgun with only the thumb and index finger and point the gun with unexpected accuracy.

Figure 4:
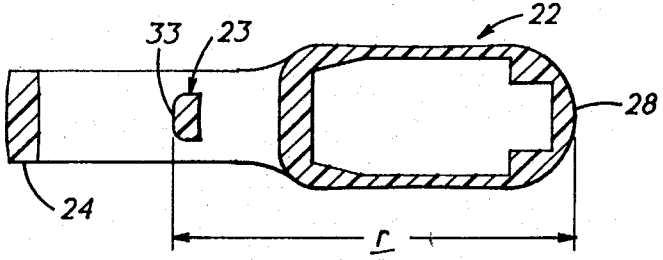
FIG. 4 is a cross-sectional view taken along 4—4 of FIG. 1.

As best shown in FIGS. 1 and 4, the location and configuration of the trigger 23 are also important ergonomic considerations of this invention. The width or transverse dimension of the concave surface of the trigger 23 is preferably between 0.350 and 0.400 inches and is defined by a radius of from approximately 0.470 to 0.900 inches. A trigger having such dimensional and surface characteristics, will ensure maximum area of engagement between the trigger face and trigger finger for the effective control the trigger pull. The concave face 33 of the trigger is preferably a smooth, matte finish similar to that of the channels 46 and 48 for easy movement and tactile sensitivity of the finger relative to the face of the trigger without being slippery or slick to the touch. As a result, the trigger pull will be easy and comfortable to the touch thus not causing any loss of tactile sensitivity or diminution of control of the trigger when firing the gun embodying this invention.

When actuated for firing the gun, the trigger finger will move the trigger 23 from a forward "ready" position, as illustrated in FIG. 1, towards a rearward "fire" position. With a trigger stroke of approximately 0.300 inch, in order minimize the tendency, especially for those having smaller hands and lesser grip strength, to move the gun off its sighting line, it is preferable that the trigger movement of its stroke length be as nearly parallel to the axis a of the barrel as feasible. To this end, it is important the pivot pin 25 for the pivotable trigger of this invention be disposed at the maximum distance from the point at which the trigger is to be actuated. In this regard, the geometric centers of the concave surface 33 of the trigger and the saddle 40 define a line parallel to the axis of the barrel a and spaced below the pin 25 by a distance of approximately 0.90 to 1.10 inches. As a result, movement of the trigger face 33 about pivot point 25 will approach rectilinear movement parallel to axis a and on being actuated, will exert only a minimum component of force, tending to pull the gun off-line. Also, because of its configuration, surface finish and the dimensional relationships, any tendency for the finger to slip over the face of the trigger when actuating the trigger in the customary fashion, will also be minimized. This construction and mounting arrangement contributes to helping the shooter to keep the gun on-line during the trigger stroke.

The lower limb 39 of the trigger guard 24 joins the front strap 26 with a smoothly contoured, concave surface 59 which has no sharp outer edges. This type of configuration assists in aiming, since a substantial portion of the weight of the handgun is generally supported by this surface resting on the upper surface of the second finger of the shooter's hand.

Figure 5:
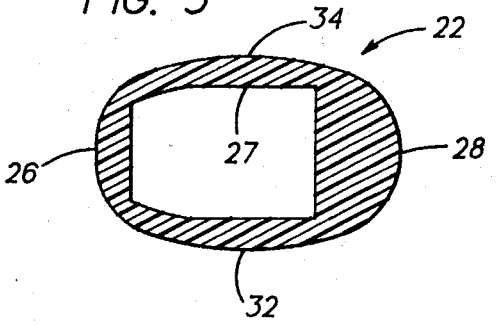
FIG. 5 is a cross-sectional view taken along line 5—5 of FIG. 1.
Figure 7:
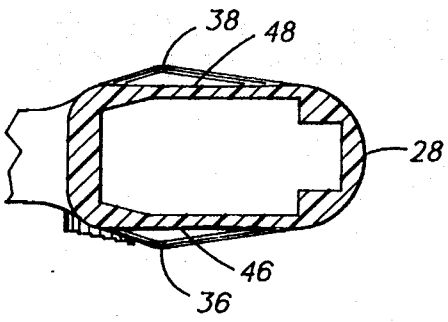
FIG. 7 is a cross sectional view taken along line 7—7 of FIG. 1.

Referring to FIGS. 3 and 6, both sides 32 and 34 of the grip 22 are generally convex or have a palm swell vertically from the lower edge 60 of the grip 22 up to the ridges 36 and 38 of approximately 20–24 inches radius to more closely conform the contours of the grip to those of the hand to thereby increase the surface area of contact between the shooter's hand and the grip. To ensure user comfort and enhance accurate aiming for a maximum number of different hand sizes, the sides surfaces 32 and 34 of the grip are also convexly curved horizontally. As shown in FIG. 5, both sides 32 and 34 are convexly curved from the front strap 26 to back strap 28 about a radius of from approximately 2 to 4 inches.

The above-described combination of ergonomic features of a handgun provide a particularly versatile handgun which allows users of widely varying physical characteristics to operate the gun comfortably and safely. Indeed, both the traditional male user as well as increasing numbers of female users of generally smaller hand size and lesser upper-body strength are able to operate the handgun of the present invention at high levels of efficiency, accuracy, safety and comfort.

It should be understood that if one skilled in the art were to develop any other handgun, a similar approach would be used but with different dimensions as required by internal mechanisms, allocated internal space, and the anthropometrics of the market and would still be within the scope of this invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. A semi-automatic handgun comprising a barrel having a longitudinal axis disposed within a slide reciprocably disposed on an upper portion of a unitary polymeric frame; the frame also including a trigger guard and lower portion adapted to receive therein a magazine, said upper portion having a trigger pivotable about a pin disposed therein so that the trigger is disposed at approximately the mid-point lengthwise of said upper portion of the frame, the trigger including a concave surface adapted to be engaged by the index finger of one's shooting hand, said trigger guard including a lower limb portion, said lower portion of the frame being disposed rearwardly of the trigger and extending downwardly at a predetermined oblique angle relative to the upper portion of the frame, the lower portion of the frame providing a handgrip for the shooting hand and comprising a front strap, a back strap and side surfaces, a concave saddle disposed between the upper end of the back strap and an upper rear portion of the frame, said concave surface of the trigger being disposed forwardly of the saddle a predetermined distance so that when the web portion of the shooting hand is fitted in centered relationship in the saddle, the outermost joint of the index finger of most adults will readily engage said concave surface of the trigger, each of the side surfaces including a ridge that runs generally from a point adjacent the lower end of the saddle toward the lower limb portion of said trigger guardvp 53 and a channel, disposed above each said ridge, adapted on one side of the frame to guide and retain the index finger toward and in engagement with the trigger and on the other side to serve, in combination with the ridge adjacent thereto, as a thumb rest.

2. The handgun of claim 1, wherein said channels have a smooth, matte finish.

3. The handgun of claim 1, in which the predetermined distance from the saddle to the center portion of the concave finger-engaging portion of the trigger is approximately 2.5 to 2.7 inches.

4. The handgun of claim 3, in which the predetermined angle between the axis of the barrel and the lower portion of the frame is approximately 106 to 110 degrees.

5. The handgun of claim 4, in which each of said ridges has a longitudinal axis that extends forwardly and downwardly at an acute angle of approximately 15 to 21 degrees from a line parallel to the axis of the barrel and which intersects the ridge line or an extension thereof to form said acute angle therewith.

6. The handgun of claim 5, in which the grip portion comprises a generally semi-cylindrical front strap surface portion having a longitudinal axis disposed at an angle of between 106 and 110 degrees from the axis of the barrel and having a cross-sectional radius of approximately 0.490–0.510 inch.

7. The handgun of claim 6, wherein the front strap and the back strap of the frame further each has a generally convex outer edge portion having a radius of approximately 0.490–0.510 inch.

8. The handgun of claim 7, when disposed in its "normal firing position," wherein a vertical plane passing through the front strap and the back strap would intersect the front strap along a straight line and would intersect the back strap along a convex curve being defined by a variable radius from approximately 10 to 15 inches.

9. The handgun of claim 8, wherein the frame further comprises longitudinally curved side surfaces disposed on each side of the grip and defined by radii of from 20 to 24 inches.

10. The handgun of claim 9, wherein the concave surface of the trigger and the saddle each has its geometric center disposed in spaced relation and which define a line parallel to the axis of the barrel and in which said line is spaced below the pin about which the trigger is pivotable, a distance of approximately 0.90 to 1.10 inches.

* * * * *

UNITED STATES PATENT AND TRADEMARK OFFICE

CERTIFICATE OF CORRECTION

PATENT NO. : 5,406,731
DATED : April 18, 1995
INVENTOR(S) : Philip H. Stevens

It is certified that error appears in the above-indentified patent and that said Letters Patent is hereby corrected as shown below:

In column 8, line 19, please delete "vp 53" after "guard".

Signed and Sealed this
Second Day of July, 1996

Bruce Lehman

*Attest:*

BRUCE LEHMAN

*Attesting Officer*

*Commissioner of Patents and Trademarks*